US007270687B2

(12) United States Patent
Doherty et al.

(10) Patent No.: US 7,270,687 B2
(45) Date of Patent: Sep. 18, 2007

(54) REDUCED EMISSIONS TRANSPORTATION FUEL

(75) Inventors: Helen M. Doherty, Bryn Mawr, PA (US); H. Randolph Roehl, Chadds Ford, PA (US)

(73) Assignee: Sunoco, Inc., Philadelphia, PA (US)

( * ) Notice: Subject to any disclaimer, the term of this patent is extended or adjusted under 35 U.S.C. 154(b) by 1216 days.

(21) Appl. No.: 09/858,188

(22) Filed: May 15, 2001

(65) Prior Publication Data

US 2003/0019787 A1 Jan. 30, 2003

(51) Int. Cl.
*C10L 1/06* (2006.01)
*C10L 1/18* (2006.01)

(52) U.S. Cl. ..... 44/449; 44/451; 208/16; 208/17; 585/14

(58) Field of Classification Search ..... 44/300, 44/451, 448, 498, 449; 585/14; 208/15, 208/16

See application file for complete search history.

(56) References Cited

U.S. PATENT DOCUMENTS

| | | | | |
|---|---|---|---|---|
| 4,313,738 | A | 2/1982 | Parlman et al. | 44/63 |
| 4,339,245 | A | 7/1982 | Burns | 44/63 |
| 4,437,436 | A | 3/1984 | Graiff et al. | 44/78 |
| 5,288,393 | A | 2/1994 | Jessup et al. | |
| H1305 | H | 5/1994 | Townsend et al. | |
| 5,593,567 | A | 1/1997 | Jessup et al. | |
| 5,653,866 | A | 8/1997 | Jessup et al. | |
| H1716 | H | 4/1998 | Rapp et al. | |
| 5,837,126 | A | 11/1998 | Jessup et al. | |
| 6,007,589 | A | 12/1999 | Talbert | |
| 6,030,521 | A | 2/2000 | Jessup et al. | |
| 6,132,479 | A | 10/2000 | Welstand et al. | |
| 6,258,987 | B1 | 7/2001 | Schmidt et al. | |
| 6,290,734 | B1 | 9/2001 | Scott et al. | |
| 6,328,772 | B1 | 12/2001 | Scott et al. | |
| 6,383,236 | B1 * | 5/2002 | Welstand et al. | 44/300 |
| 6,419,716 | B2 | 7/2002 | Scott et al. | 44/451 |
| 6,540,797 | B1 | 4/2003 | Scott et al. | 44/451 |
| 2002/0045785 | A1 * | 4/2002 | Bazzani et al. | 585/14 |
| 2002/0068842 | A1 * | 6/2002 | Brundage et al. | 585/14 |
| 2003/0150155 | A1 * | 8/2003 | Barbour et al. | 44/451 |

FOREIGN PATENT DOCUMENTS

| | | | |
|---|---|---|---|
| JP | 1009293 | | 1/1989 |
| JP | 3263493 | A1 | 11/1991 |
| JP | 63317593 | | 12/1998 |
| WO | 0166674 | A1 | 9/2001 |

OTHER PUBLICATIONS

CRC Report No. 477, 1973 CRC Fuel Rating Program Part 1: Road Octane Performance in 1973 Model Cars, Feb. 1975, pp. 16 and 17.*

S.A.E. Report: The Effect of Fuel Composition, Equivalence Ratio, and Mixture Temperature on Exhaust Emissions; R.D. Fleming and D.B. Eccleston. Bartlesville Petroleum Research Center, U.S. Bureau of Mines, Automotive Engineering Congress, Detroit Michigan Jan. 11-15, 1971.

S.A.E. Report: Gasolines for Low-Emission Vehicles; J.C. Ellis, 1973 SAE Section Meetings.

1990 CRC Octane Number Requirement Survey, Jul. 1991.

1989 CRC Octane Number Requirement Survey, Aug. 1990.

SAE Technical Paper Series: Distillation Adjustment: An Innovative Step to Gasoline Reformulation, Jeff A. Gething, Chevron Research and Technology Company. 1991 SAE International Congress and Exposition, Detroit Michigan Feb. 15-Mar. 1, 1991.

Auto/Oil Air Quality Improvement Research Program, Technical Bulletin No. 1, Initial Mass Exhaust Emissions Results from Reformulated Gasolines. Dec. 1990.

CRC Report No. 461, Analysis of 1971 Road Rating Data: Unleaded Gasolines in 1971 Cars, Phase II: 1970-71 CRC Road Rating Program, Jun. 1973.

CRC Report: Effect of Volatility and Oxygenates on Driveability at Intermediate Ambient Temperatures (CRC Project No. CM-118-89), Mar. 1992.

Eccleston, et al., "*Comparative Emissions From Some Leaded and Prototype Lead-Free Automobile Fuels*"; 1970, pp. 1-24.

Corbett, R.A., "*Auto/Oil Progressing Toward Cleaner Fuel Compositions*", vol. 1, No. 1, Sep./Oct. 1991, pp. 46-50.

Colucci, J.M., "*Automotive Fuels for the 1990's—Challenges and Opportunities*", pp. 1-34 and 51, 52.

Exxon Research and Engineering Company, "*The Effect of Fuel Volatility Variations on Evaporative and Exhaust Emissions*", May 1979, pp. 1-79.

Battelle Columbus Laboratories, "*Motor-Fuel Composition and Photochemical Smog*", Apr. 1975, pp. 1-102 and Appendices Al-Hl.

Doelling, et al., "*Effect of Gasoline Characteristics on Automotive Exhaust Systems*", 1971, pp. 20-35.

Boekhaus, et al., "*Reformulated Gasoline for Clean Air, An ARCO Assessment*", Jul. 12, 1990, pp. pp. 1-39.

Coordinating Research Council, Inc. "*1983 CRC Octane Number Requirement Survey*", Aug. 1983, pp. 1-16.

Coordinating Research Council, Inc. "*1982 CRC Octane Number Requirement Survey*", Jul. 1983, pp. 1-12.

Coordinating Research Council, Inc. "*1978 Fuel Rating Program: Road Octane Performance in 1978 Model Cars*", Aug. 1979, pp. 1-5.

Date, K. et al., "*Road Octane Number Trends of Japanese Passenger Cars*", pp. 1-18.

(Continued)

*Primary Examiner*—Ellen M. McAvoy
(74) *Attorney, Agent, or Firm*—Robert A. Koons, Jr., Esq.; Drinker, Biddle & Reath

(57) ABSTRACT

Transportation fuels are provided that have reduced toxics, VOC and $NO_x$ emissions, as well as, reduced sulfur content. The transportation fuels provided meet emissions reduction requirements determined by using the EPA Complex Model and for reduced sulfur. Reduction in sulfur content allows the use of components with high concentrations of olefins, while still reducing toxics, hydrocarbon (VOCs) and $NO_x$ emissions to acceptable levels.

4 Claims, No Drawings

OTHER PUBLICATIONS

Niles, H.T., "*Establishment of On Characteristics As A Function Of Selected Fuels And Engine Families*", pp. 1-19.

Wimmer, D.B., et al., "*An Evaluation of the Performance and Emissions of a CFR Engine Equipped With a Prechamber*". Society of Automotive Engineers, May 14-18, 1973, 1442-1457.

Jessup, P.J., et al., "*An Overview of Unocal's Low Emission Gasoline Research Program*", Society of Automotive Engineers, Feb. 24-28, 1992; pp. 171-192.

Koehl, W.J., "*Effects of Gasoline Composition and Properties on Vehicle Emissions: A Review of Prior Studies—Auto/Oil Air Quality Improvement Research Program*" Society of Automotive Engineers, Oct. 7-10, 1991, pp. 1-33.

Stump, F.D., "*The Seasonal Impact of Blending Oxygenated Organics With Gasoline on Motor Vehicle Tailpipe and Evaporative Emissions—Part II*", pp. 1-34.

Pahl, R.H., et al., "*Fuel Blending and Analysis for the Auto/Oil Air Quality Improvement Research Program*", Society of Automotive Engineers, Oct. 22-25, 1990, pp. 1-11.

Hoshi, H., et al., "*Effects of Gasoline Composition on Exhaust Emissions and Driveability*", Society of Automotive Engineers, Oct. 22-25, 1990, pp. 1-9.

Gething, et al., "*The Effect of Gasoline Aromatics Content on Exhaust Emissions: A Cooperative Test Program*", Society of Automotive Engineers, Oct. 22-25, 1990, pp. 1-13.

Quader, A.A., "*How Injector, Engine, and Fuel Variables Impact Smoke and Hydrocarbon Emissions with Port Fuel Injection*", Society of Automotive Engineers, Feb. 17-Mar. 3, 1989, pp. 1-23.

Nishizaki, T., et al., "*The Effects of Fuel Composition and Fuel Additives on Intake System Detergency of Japanese Automobile Engine*", pp. 1-14.

Healy, W.C., et al., "*A New Approach to Blending Octanes*", Proceedings American Petroleum Institute 1959, Section III-Relining, Addresses and Reports, vol. 39 (III), 1959, pp. 132-192.

EPA Office of Mobile Sources, "*Is Reformulated Gasoline a "New" Gasoline?*", Apr. 1995, pp. 1-3.

Toyota Motor Corporation, "*Effect of Gasoline Property on Exhaust Emissions and Driveability*", Oct. 1990, pp. 1-19.

* cited by examiner

REDUCED EMISSIONS TRANSPORTATION FUEL

The invention relates to reduced emissions transportation fuels, formulated to reduce emissions of toxics, hydrocarbons (VOCs) and $NO_x$. More particularly, the invention relates to transportation fuels that are formulated to reduce emissions of toxics, hydrocarbons (VOCs) and $NO_x$, and have reduced sulfur content.

BACKGROUND OF THE INVENTION

There are many challenges for U.S. refiners to produce fuels that comply with environmental regulations and meet vehicle performance requirements. Federal and State Governments have regulated gasoline properties for many years. Generally, these regulations were developed to meet air quality goals. In 1990, the Federal Government issued the Clean Air Act Amendments, which required significant changes to gasoline used in certain areas of the United States.

Beginning Jan. 1, 1998, refiners had to certify their reformulated gasolines using the EPA Complex Model, a computer model that predicts emissions performance. The properties used in the Complex Model to predict emissions performance are: methyl tert-butyl ether (MTBE) (wt. % oxygen), ethyl tert-butyl ether (ETBE) (wt. % oxygen), Ethanol (wt. % oxygen), Methanol (wt. % oxygen), tert-amyl methyl ether (TAME) (wt. % oxygen), sulfur (ppm), Reid Vapor Pressure (psi), 50% D-86 distillation point (° F.) or E200(%), 90% D-86 distillation point (° F.) or E300(%), aromatics (vol %), olefins (vol %), and benzene (vol %).

U.S. Pat. Nos. 5,288,393, 5,593,567, 5,653,866, 5,837,126 and 6,030,521 indicate that the primary factor effecting $NO_x$ emissions is Reid Vapor Pressure (RVP), with the 10% D-86 Distillation Point and Olefins content being of secondary importance. It is reported that since reductions in 10% D-86 Distillation Point are often unacceptable for performance reasons, olefins content is generally to be used as the secondary variable in decreasing $NO_x$ emissions. These U.S. Patents report that a Reid Vapor Pressure of less than 8.0 psi and an olefins content not exceeding 15% by weight are preferred for $NO_x$ emissions reductions. These U.S. Patents also reports that 50% D-86 and distillation points not exceeding 215° F. are preferred for reducing hydrocarbon and carbon monoxide emissions.

An olefins content of less than 15% by weight is generally not difficult to achieve in high octane blends, such as 93 octane gasoline, since these fuels are generally low in olefins due to the components used to produce them. However, it is more difficult to achieve this olefins content in lower octane fuels, such as 87 octane, because of the high olefins content of the components used to produce these fuels.

An additional issue facing refiners is the pending implementation of the EPA Tier 2 Motor Vehicle Emissions Standards and Gasoline Sulfur Control Requirements. Beginning in 2004, refiners must produce gasoline that averages 120 ppm sulfur with a batch limit of 300 ppm. In 2005, gasoline sulfur levels must average 90 ppm with a 300 ppm cap, and in 2006, these limits are a 30 ppm average with an 80 ppm cap.

It is desirable to produce transportation fuels that meet the emissions reductions requirements determined using EPA Complex Model and can be produced using components having a high concentration of olefins. It is further desirable to produce transportation fuels that meet the emissions reductions requirements using the EPA Complex Model and have reduced sulfur content.

SUMMARY OF THE INVENTION

The current invention provides transportation fuels that meet the emissions requirements for toxics, VOC and $NO_x$ as determined using the EPA Complex Model. Reductions in $NO_x$ emissions are achieved primarily by controlling the 90% D-86 distillation point, olefins content, aromatics content and sulfur content. Reductions in VOC emissions are achieved primarily by controlling Reid Vapor Pressure and secondarily by controlling aromatics content. Reductions in toxics emissions is achieved primarily by controlling aromatics and benzene content, 90% D-86 distillation point and the use of oxygenates. Transportation fuels according to the current invention can have olefins content from about 0-25% by weight, preferably about 15-25%. Sulfur content in transportation fuels according to the current invention is less than about 300 ppm, preferably less than about 120 ppm, and most preferably less than about 80 ppm. Reduced sulfur content in transportation fuels according to the current invention allows higher olefins content and higher 50 and 90% D-86 distillation points than would otherwise be required for meeting emissions reduction requirements.

DETAILED DESCRIPTION OF THE INVENTION

The present invention relates to transportation fuels blended to comply with the requirements for emissions reduction, determined using the EPA Complex Model. The EPA Complex Model uses the following parameters for estimating $NO_x$, VOC and toxics emissions: methyl tert-butyl ether (wt. % oxygen), ethyl tert-butyl ether (wt. % oxygen), ethanol (wt. % oxygen), methanol (wt. % oxygen), tert-amyl methyl ether (wt. % oxygen), sulfur (ppm), Reid Vapor Pressure, D-86 50% distillation point (° F.) or E200 (%), D-86 90% distillation point (° F.) or E300 (%), aromatics (volume %), olefins (volume %) and benzene (volume %). As defined in the complex model, the wt. % oxygen contributed by an oxygenating component, such as methyl tert-butyl ether, is the percent oxygen content in the fuel blend on a total weight basis. As defined in the EPA Complex Model, the E200 (%) and E300 (%) are the percentages of a fuel that vaporizes at 200° F. and 300° F. respectively.

Fuels according to the current invention were blended to comply with the requirements for reductions in $NO_x$ emissions by controlling at least one of the following properties from the EPA Complex Model: the 90% D-86 distillation point, olefins content, aromatics content and sulfur content, as indicated in the tables. VOC emissions are controlled by controlling Reid Vapor Pressure and aromatics content. Toxics emissions are controlled by controlling aromatics and benzene content, 90% D-86 distillation point and the use of oxygenates.

According to one embodiment, fuels of the current invention have octane ratings of 94 (R+M)/2 or lower, preferred octane ratings being 87, 93 and 94. The 50% D-86 distillation point of fuels according to this embodiment of the invention is less than about 235° F., preferably from about 215° F. to about 235° F. The 90% D-86 distillation point of fuels according to this embodiment of the invention is less than about 360° F., preferably from about 315° F. to about 360° F. Olefins content of fuels according to this embodiment of the invention is less than about 25%, preferably from about 15% to about 25%.

Aromatics content of fuels according to this embodiment of the invention is less than about 47%, preferably from about 20% to about 40%. Sulfur content for fuels according to this embodiment of the invention is less than about 300 ppm. Preferably, the sulfur content of fuels according to this embodiment of the invention is about 120 ppm or less, more preferably about 80 ppm or less.

Fuels according to this embodiment of the invention fall into two basic categories, oxygenated and non-oxygenated fuels. For the purposes of the invention, non-oxygenated fuels are those fuels that contain less than 0.1% oxygen by weight. In preferred embodiments, oxygen can be introduce by using oxygenating components, such as: ethyl tert-butyl ether (EtBE), methyl tert-butyl ether (MtBE), tert-amyl methyl ether (TAME), ethanol and methanol. Selection of a particular oxygenating component is within the purview of an individual skilled in the art.

It will be recognized that the examples presented here are for illustrative purposes only and should not be construed as placing a limitation upon the scope of the invention. Further the development of procedures for blending hydrocarbon streams to achieve fuels having the desired content of the several components listed in Tables 1, 2, 3 and 4 can be carried out by one skilled in the art, without undue experimentation. Methods for developing procedures for blending hydrocarbon streams to produce fuels having the desired content of aromatics, olefins, etc., as well as 10, 50 and 90% D-86 distillation points include, but are not limited to, linear programming and non-linear programming. Those skilled in the art will recognize that the fuel blends of the current invention are not limited to a particular method of developing blending procedures to produce them.

Tables 1, 2, 3 and 4 show examples of transportation fuels of various octane ratings according to the current invention. The examples shown in Tables 1, 3 and 4 are oxygenated fuels. Table 2 shows non-oxygenated fuels. The values presented for olefins and aromatics content in Tables 1, 2, 3 and 4 are not corrected for content of oxygenates. Tables 5, 6, 7 and 8 show emissions of toxics, VOCs and $NO_x$ for the fuels shown in Tables 1, 2, 3 and 4, and reductions versus emissions for an industry average baseline fuel calculated using the EPA Complex Model. The industry average baseline fuel has the following properties: 339 ppm sulfur, 1.53% benzene, 8.7 psi RVP, 87.3(R+M)/2, 128F T10, 218F T50, 330F T90, 32% aromatics, 9.2% olefins and 58.8% saturates. These values represent average 1990 nationwide (excluding California) gasoline composition.

The values for aromatics, benzene, olefins and sulfur content reported in Tables 1, 2, 3 and 4 were corrected for oxygen content prior to being used to calculate emissions for the example fuels in the EPA Complex Model.

The data from Tables 5, 6, 7 and 8 show a decrease in emissions of toxics, VOCs and $NO_x$ versus the baseline fuel. Table 6 shows emissions for non-oxygenated fuels. Tables 5, 7 and 8 show emissions for oxygenated fuels according to a preferred embodiment. Emissions values for toxics, $NO_x$ and VOCs is reported in mg/mile. The values for percentage reduction are calculated versus an industry average baseline fuel. In addition, all fuels according to this embodiment meet the EPA requirement of not more than 300 ppm sulfur. Non-oxygenated fuels according to the current invention show a reduction in toxics emissions of up to about 28%, a reduction in $NO_x$ emissions of up to about 14%, and a reduction in VOC emissions of up to about 22% versus an industry average baseline fuel. Oxygenated fuels according to the current invention show a reduction in toxics emissions of up to about 40%, a reduction in $NO_x$ emissions of up to about 16%, and a reduction in VOC emissions of up to about 36% versus an industry average baseline fuel.

According to another embodiment, the current invention provides a blend stock for use in blending with oxygenates to produce an oxygenated fuel. Blend stocks according to this embodiment have an octane rating of at least 83.5 and are suitable for blending with oxygenates to produce a reduced emissions transportation fuel. Blend stocks according to this embodiment of the invention have a 50% D-86 distillation point of less than about 232° F., preferably from about 215° F. to about 232° F., and a 90% D-86 distillation point less than about 360° F., preferably from about 315° F. to about 360° F. The aromatics content of blend stocks according to this embodiment of the invention is less than about 33%, preferably from about 14% to about 33%. The olefins content of blend stocks according to this embodiment of the invention is less than about 21%, preferably from about 15% to about 21%.

Blend stocks according to this embodiment of the invention are blended with an oxygenating component to produce an oxygenated transportation fuel. Such oxygenating components include ethyl tert-butyl ether (EtBE), methyl tert-butyl ether (MtBE), tert-amyl methyl ether (TAME), ethanol and methanol.

A preferred embodiment provides a blend stock having an octane rating of 83.5. According to this embodiment, the blend stock is blended with ethanol to produce a transportation fuel having an octane rating of from about 87 to about 90. Table 9 shows examples of fuels produced from a blend stock according to this preferred embodiment, blended with ethanol. Table 10 shows emissions data for the examples in Table 9. Fuels produced from blend stocks according to this embodiment show a reduction in toxics emissions of up to about 26%, a reduction in $NO_x$ emissions of up to about 10%, and a reduction in VOCs of up to about 25%. Reductions in emissions were determined versus an industry standard baseline fuel.

TABLE 1

87 RFG Blends

| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) | oxygen cont. (%) |
|---|---|---|---|---|---|---|---|---|---|---|---|---|---|---|
| 0001 | 87 | 6.83 | 16.85 | 0.28 | 13.93 | 208 | 352 | 156 | 1.858 | 0 | 0 | 0 | 0 | 1.858 |
| 0002 | 87 | 6.35 | 15.94 | 0.62 | 17.17 | 193 | 343 | 203 | 2.541 | 0 | 0.016 | 0.025 | 0 | 2.582 |
| 0003 | 87 | 6.83 | 16.47 | 0.55 | 15.78 | 190 | 336 | 34 | 2.503 | 0 | 0 | 0 | 0 | 2.503 |
| 0004 | 87 | 6.60 | 24.81 | 0.57 | 11.57 | 219 | 316 | 102 | 1.949 | 0 | 0 | 0 | 0 | 1.949 |
| 0005 | 87 | 6.92 | 22.48 | 0.82 | 11.66 | 195 | 337 | 126 | 2.104 | 0 | 0 | 0 | 0 | 2.104 |
| 0006 | 87 | 7.31 | 23.51 | 0.54 | 11.76 | 188 | 331 | 135 | 2.092 | 0 | 0.005 | 0 | 0 | 2.097 |

TABLE 1-continued

87 RFG Blends

| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) | oxygen cont. (%) |
|---|---|---|---|---|---|---|---|---|---|---|---|---|---|---|
| 0007 | 87 | 6.83 | 18.68 | 0.56 | 23.63 | 193 | 348 | 143 | 2.679 | 0 | 0.002 | 0 | 0 | 2.681 |
| 0008 | 87 | 6.69 | 18.02 | 0.53 | 12.37 | 182.8 | 336 | 146 | 2.6 | 0 | 0.002 | 0 | 0 | 2.602 |
| 0009 | 87 | 7.31 | 23.45 | 0.49 | 12.75 | 197 | 340.7 | 154 | 2.042 | 0 | 0.004 | 0 | 0 | 2.046 |
| 0010 | 87 | 7.03 | 22.36 | 0.47 | 10.76 | 195 | 347 | 166 | 1.945 | 0 | 0 | 0 | 0 | 1.945 |
| 0011 | 87 | 6.35 | 20.76 | 0.45 | 12.22 | 201 | 343 | 168 | 2.374 | 0 | 0 | 0 | 0 | 2.374 |
| 0012 | 87 | 7.06 | 23.17 | 0.45 | 13.44 | 209 | 347 | 171 | 1.782 | 0 | 0 | 0 | 0 | 1.782 |
| 0013 | 87 | 6.66 | 17.98 | 0.43 | 19.5 | 196 | 343 | 172 | 2.683 | 0 | 0.014 | 0.2 | 0 | 2.897 |
| 0014 | 87 | 6.56 | 34.25 | 0.58 | 18.06 | 198 | 341 | 189 | 2.626 | 0 | 0.002 | 0 | 0 | 2.628 |
| 0015 | 87 | 7.18 | 12.8 | 0.59 | 12.82 | 191.6 | 321.6 | 190 | 2.597 | 0 | 0 | 0 | 0 | 2.597 |
| 0016 | 87 | 6.73 | 23.81 | 0.5 | 15.93 | 219 | 347 | 239 | 2.584 | 0 | 0 | 0 | 0 | 2.584 |
| 0017 | 87 | 6.9 | 15.87 | 0.49 | 19.73 | 201 | 353 | 284 | 2.579 | 0 | 0 | 0 | 0 | 2.579 |
| 0018 | 87 | 6.57 | 17.09 | 0.57 | 19.44 | 197 | 348 | 298 | 2.312 | 0 | 0.008 | 0 | 0 | 2.32 |

TABLE 2

93N Blends

| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) | oxygen cont. (%) |
|---|---|---|---|---|---|---|---|---|---|---|---|---|---|---|
| 0019 | 93 | 6.63 | 31.86 | 0.59 | 7.71 | 230 | 319 | 41 | 0.03 | 0 | 0 | 0 | 0 | 0.03 |
| 0020 | 93 | 6.47 | 30.76 | 0.59 | 1.2 | 234 | 316 | 27 | 0.039 | 0 | 0 | 0 | 0 | 0.039 |
| 0021 | 93 | 6.15 | 27.33 | 0.45 | 1.3 | 231.7 | 312.1 | 34 | 0.049 | 0 | 0 | 0 | 0 | 0.049 |
| 0022 | 93 | 6.19 | 28.73 | 0.73 | 3.11 | 228 | 308 | 34 | 0.046 | 0 | 0 | 0 | 0 | 0.046 |
| 0023 | 93 | 6.4 | 36.18 | 0.82 | 4.8 | 227 | 312 | 36 | 0.016 | 0 | 0 | 0 | 0 | 0.016 |
| 0024 | 93 | 6.44 | 31.47 | 0.62 | 8.61 | 232.2 | 321.8 | 42 | 0.03 | 0 | 0 | 0 | 0 | 0.03 |
| 0025 | 93 | 6.54 | 24.1 | 0.55 | 5.71 | 224 | 310 | 57 | 0.028 | 0 | 0 | 0 | 0 | 0.028 |
| 0026 | 93 | 6.5 | 34.59 | 0.74 | 7.61 | 228 | 316 | 66 | 0.03 | 0 | 0 | 0 | 0 | 0.03 |
| 0027 | 93 | 6.5 | 35.73 | 0.77 | 3.3 | 231 | 317 | 25 | 0.16 | 0 | 0 | 0 | 0 | 0.016 |
| 0028 | 93 | 6.58 | 35.97 | 0.86 | 4.9 | 228.9 | 313.4 | 24 | 0.015 | 0 | 0 | 0 | 0 | 0.015 |
| 0029 | 93 | 6.7 | 35.19 | 0.61 | 3.81 | 229.5 | 321.6 | 27 | 0.03 | 0 | 0 | 0 | 0 | 0.03 |
| 0030 | 93 | 6.45 | 30.37 | 0.54 | 6.01 | 230 | 320 | 32 | 0.019 | 0 | 0 | 0 | 0 | 0.019 |
| 0031 | 93 | 6.44 | 28.05 | 0.6 | 5.41 | 229 | 310 | 42 | 0.043 | 0 | 0 | 0 | 0 | 0.043 |
| 0032 | 93 | 6.51 | 25.77 | 0.56 | 5.41 | 227 | 319 | 70 | 0.035 | 0 | 0 | 0 | 0 | 0.035 |

TABLE 3

93RFG Blends

| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) | oxygen cont. (%) |
|---|---|---|---|---|---|---|---|---|---|---|---|---|---|---|
| 0033 | 93 | 6.72 | 25.31 | 0.34 | 9.77 | 216 | 330 | 3 | 2.507 | 0 | 0 | 0 | 0 | 2.507 |
| 0034 | 93 | 6.69 | 31.05 | 0.48 | 5.08 | 219.7 | 325.3 | 65 | 2.387 | 0 | 0 | 0 | 0 | 2.387 |
| 0035 | 93 | 6.82 | 30.39 | 0.55 | 7.17 | 219 | 328 | 84 | 2.166 | 0 | 0 | 0 | 0 | 2.166 |
| 0036 | 93 | 6.66 | 36.31 | 0.72 | 9.36 | 222.8 | 332.8 | 88 | 1.98 | 0 | 0 | 0 | 0 | 1.98 |
| 0037 | 93 | 6.4 | 35.52 | 0.56 | 9.46 | 220 | 327 | 90 | 2.163 | 0 | 0 | 0 | 0 | 2.163 |
| 0038 | 93 | 6.76 | 36.97 | 0.65 | 11.48 | 217.2 | 328.5 | 90 | 2.559 | 0 | 0 | 0 | 0 | 2.559 |
| 0039 | 93 | 6.43 | 21.73 | 0.29 | 10.78 | 212 | 328 | 97 | 2.628 | 0 | 0 | 0 | 0 | 2.628 |
| 0040 | 93 | 6.61 | 22.66 | 0.3 | 9.84 | 212 | 328 | 102 | 2.642 | 0 | 0 | 0 | 0 | 2.642 |
| 0041 | 93 | 6.53 | 26.53 | 0.37 | 13.33 | 213.5 | 328.7 | 106 | 2.575 | 0 | 0.002 | 0 | 0 | 2.577 |
| 0042 | 93 | 6.87 | 35.31 | 0.63 | 13.26 | 209.5 | 330.8 | 108 | 2.593 | 0 | 0 | 0 | 0 | 2.593 |
| 0043 | 93 | 6.89 | 25.59 | 0.39 | 11 | 212 | 327 | 110 | 2.604 | 0 | 0.002 | 0 | 0 | 2.606 |
| 0044 | 93 | 7.02 | 32.14 | 0.6 | 11.81 | 209 | 322 | 114 | 2.561 | 0 | 0 | 0 | 0 | 2.561 |
| 0045 | 93 | 6.76 | 26.2 | 0.42 | 13.17 | 222.8 | 332.8 | 272 | 2.535 | 0 | 0.004 | 0 | 0 | 2.539 |
| 0046 | 93 | 6.85 | 27.63 | 0.53 | 7.34 | 217 | 328 | 83 | 2.042 | 0 | 0 | 0 | 0 | 2.042 |
| 0047 | 93 | 6.93 | 30.52 | 0.44 | 10.87 | 211 | 329 | 102 | 2.237 | 0 | 0.002 | 0 | 0 | 2.239 |
| 0048 | 93 | 6.47 | 25.82 | 0.45 | 10.06 | 215.1 | 327.5 | 94 | 2.587 | 0 | 0.005 | 0 | 0 | 2.592 |
| 0049 | 93 | 6.76 | 22.17 | 0.31 | 11.36 | 214 | 331 | 84 | 2.618 | 0 | 0 | 0 | 0 | 2.618 |
| 0050 | 93 | 6.7 | 23.36 | 0.32 | 11.71 | 212 | 332 | 95 | 2.625 | 0 | 0.002 | 0 | 0 | 2.627 |

TABLE 4

| 94 RFG Blends | | | | | | | | | | | | | | |
|---|---|---|---|---|---|---|---|---|---|---|---|---|---|---|
| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) | oxygen cont. (%) |
| 0051 | 94 | 6.6 | 26.42 | 0.39 | 2.18 | 221 | 313 | 18 | 2.33 | 0 | 0.002 | 0 | 0 | 2.332 |
| 0052 | 94 | 6.67 | 25.46 | 0.39 | 15.49 | 214.5 | 325.3 | 30 | 2.643 | 0 | 0 | 0 | 0 | 2.643 |
| 0053 | 94 | 6.76 | 29.17 | 0.4 | 1.25 | 220 | 304 | 44 | 2.184 | 0 | 0 | 0 | 0 | 2.184 |
| 0054 | 94 | 6.48 | 25.37 | 0.38 | 1.8 | 218 | 304 | 52 | 1.971 | 0 | 0 | 0 | 0 | 1.971 |
| 0055 | 94 | 6.35 | 31.14 | 0.5 | 9.44 | 219.3 | 323.3 | 54 | 2.518 | 0 | 0 | 0 | 0 | 2.518 |
| 0056 | 94 | 6.57 | 37.21 | 0.49 | 7.87 | 221 | 314 | 56 | 2.657 | 0 | 0 | 0 | 0 | 2.657 |
| 0057 | 94 | 6.7 | 22.82 | 0.27 | 5.05 | 216 | 316 | 62 | 2.67 | 0 | 0.002 | 0 | 0 | 2.672 |
| 0058 | 94 | 6.41 | 34.5 | 0.63 | 7.52 | 220 | 320 | 65 | 2.388 | 0 | 0 | 0 | 0 | 2.388 |
| 0059 | 94 | 6.56 | 29.31 | 0.41 | 2.52 | 228 | 312 | 67 | 2.289 | 0 | 0 | 0 | 0 | 2.289 |
| 0060 | 94 | 6.7 | 22.15 | 0.34 | 5.18 | 217 | 318 | 69 | 2.726 | 0 | 0.002 | 0 | 0 | 2.728 |
| 0061 | 94 | 6.5 | 36.58 | 0.7 | 8.27 | 219.6 | 318.9 | 70 | 2.486 | 0 | 0 | 0 | 0 | 2.486 |
| 0062 | 94 | 6.61 | 45.97 | 0.33 | 12.26 | 219 | 314 | 71 | 2.554 | 0 | 0 | 0 | 0 | 2.554 |
| 0063 | 94 | 6.43 | 37.22 | 0.51 | 10.22 | 223 | 323 | 79 | 2.258 | 0 | 0 | 0 | 0 | 2.258 |
| 0064 | 94 | 6.86 | 26.9 | 0.41 | 12.96 | 211 | 323 | 82 | 2.575 | 0 | 0 | 0 | 0 | 2.575 |
| 0065 | 94 | 6.53 | 22.62 | 0.36 | 3.34 | 217 | 307 | 84 | 2.393 | 0 | 0 | 0 | 0 | 2.393 |
| 0066 | 94 | 6.74 | 29.41 | 0.44 | 9.6 | 219 | 331 | 96 | 2.589 | 0 | 0 | 0 | 0 | 2.589 |
| 0067 | 94 | 6.6 | 32.09 | 0.49 | 7.26 | 219.3 | 325.8 | 111 | 2.587 | 0 | 0.005 | 0 | 0 | 2.592 |

TABLE 5

| 87 RFG Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0001 | 53.663 | 37.85 | 1220.804 | 8.89 | 1009.539 | 31.15 |
| 0002 | 54.617 | 36.75 | 1260.524 | 5.93 | 943.339 | 35.67 |
| 0003 | 51.757 | 40.06 | 1161.106 | 13.35 | 960.592 | 34.49 |
| 0004 | 57.1 | 33.87 | 1198.895 | 10.53 | 1009.908 | 31.13 |
| 0005 | 57.73 | 33.14 | 1218.239 | 9.08 | 1013.739 | 30.86 |
| 0006 | 55.512 | 35.71 | 1231.645 | 8.09 | 1050.877 | 28.33 |
| 0007 | 55.614 | 35.59 | 1310.781 | 2.18 | 974.642 | 33.53 |
| 0008 | 52.42 | 39.29 | 1213.766 | 9.42 | 965.87 | 34.13 |
| 0009 | 56.221 | 34.89 | 1244.89 | 7.10 | 1067.402 | 27.20 |
| 0010 | 55.912 | 35.24 | 1237.985 | 7.61 | 1045.064 | 28.73 |

TABLE 5-continued

| 87 RFG Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0011 | 54.525 | 36.85 | 1228.115 | 8.35 | 974.231 | 33.56 |
| 0012 | 57.583 | 33.31 | 1255.382 | 6.31 | 1069.352 | 27.07 |
| 0013 | 53.964 | 37.50 | 1273.615 | 4.95 | 970.785 | 33.794 |
| 0014 | 60.783 | 29.60 | 1323.784 | 1.21 | 1014.197 | 30.83 |
| 0015 | 52.563 | 39.12 | 1210.381 | 9.67 | 1015.472 | 30.75 |
| 0016 | 57.985 | 32.84 | 1292.061 | 3.58 | 1040.895 | 29.01 |
| 0017 | 56.083 | 35.05 | 1318.623 | 1.60 | 1008.762 | 31.20 |
| 0018 | 57.318 | 33.62 | 1333.292 | 0.50 | 980.26 | 33.15 |

TABLE 6

| 93N Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0019 | 65.15 | 34.55 | 1171.869 | 12.55 | 1171.869 | 20.08 |
| 0020 | 64.189 | 25.66 | 1148.856 | 14.26 | 1148.856 | 21.65 |
| 0021 | 61.009 | 29.34 | 1145.354 | 14.53 | 1145.354 | 21.89 |
| 0022 | 64.495 | 25.30 | 1150.499 | 14.14 | 1150.499 | 21.54 |
| 0023 | 70.126 | 18.78 | 1164.217 | 13.12 | 1164.217 | 20.60 |
| 0024 | 65.794 | 23.80 | 1172.023 | 12.54 | 1172.023 | 20.07 |
| 0025 | 60.718 | 29.68 | 1156.487 | 13.70 | 1156.487 | 21.13 |
| 0026 | 68.982 | 20.11 | 1188.81 | 11.28 | 1188.81 | 18.93 |
| 0027 | 68.993 | 20.10 | 1156.441 | 13.70 | 1156.441 | 21.13 |
| 0028 | 70.24 | 18.65 | 1157.309 | 13.63 | 1157.309 | 21.07 |

TABLE 6-continued

| 93N Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0029 | 66.628 | 22.83 | 1160.761 | 13.38 | 1160.761 | 20.84 |
| 0030 | 63.824 | 26.08 | 1154.843 | 13.82 | 1154.843 | 21.24 |
| 0031 | 63.285 | 26.71 | 1153.867 | 13.89 | 1153.867 | 21.31 |
| 0032 | 62.031 | 28.16 | 1167.365 | 12.88 | 1167.385 | 20.39 |

TABLE 7

| 93 RFG Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0033 | 52.728 | 38.93 | 1131.315 | 15.57 | 1008.601 | 31.22 |
| 0034 | 56.823 | 34.19 | 1174.724 | 12.33 | 1042.582 | 28.90 |
| 0035 | 58.161 | 32.64 | 1188.805 | 11.28 | 1054.784 | 28.07 |
| 0036 | 63.21 | 26.79 | 1209.203 | 9.76 | 1066.4 | 27.27 |
| 0037 | 60.566 | 29.86 | 1208.29 | 9.83 | 1031.563 | 29.65 |
| 0038 | 61.071 | 29.27 | 1218.305 | 9.08 | 1053.511 | 28.15 |
| 0039 | 52.155 | 39.60 | 1177.518 | 12.13 | 980.074 | 33.16 |
| 0040 | 52.396 | 39.32 | 1181.889 | 11.80 | 995.448 | 32.11 |
| 0041 | 54.755 | 36.59 | 1213.297 | 9.46 | 996.42 | 32.05 |
| 0042 | 60.195 | 30.28 | 1239.889 | 7.47 | 1048.015 | 28.53 |
| 0043 | 54.314 | 37.10 | 1202.598 | 10.25 | 1026.829 | 29.97 |
| 0044 | 58.593 | 32.14 | 1229.95 | 8.21 | 1051.698 | 28.28 |
| 0045 | 57.535 | 33.37 | 1295.935 | 3.29 | 1033.95 | 29.49 |
| 0046 | 57.107 | 33.86 | 1183.611 | 11.67 | 1047.105 | 28.59 |
| 0047 | 57.147 | 33.82 | 1216.821 | 9.19 | 1045.436 | 28.70 |
| 0048 | 54.774 | 36.56 | 1187.554 | 11.38 | 998.079 | 31.93 |
| 0049 | 54.482 | 39.22 | 1174.942 | 12.32 | 1007.71 | 31.28 |
| 0050 | 52.954 | 38.67 | 1188.511 | 11.31 | 1002.73 | 31.62 |

TABLE 8

| 94 RFG Blends | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0051 | 54.023 | 37.43 | 1127.058 | 15.89 | 1038.065 | 29.21 |
| 0052 | 53.703 | 37.80 | 1175.604 | 12.27 | 992.671 | 32.30 |
| 0053 | 55.309 | 35.94 | 1155.202 | 13.79 | 1045.575 | 28.69 |
| 0054 | 54.246 | 37.17 | 1150.07 | 14.17 | 1016.016 | 30.71 |
| 0055 | 56.737 | 34.29 | 1173.981 | 12.39 | 1025.477 | 30.06 |
| 0056 | 58.424 | 32.34 | 1180.476 | 11.90 | 1027.691 | 29.91 |
| 0057 | 51.549 | 40.30 | 1145.58 | 14.51 | 1016.879 | 30.65 |
| 0058 | 59.513 | 31.07 | 1183.136 | 11.71 | 1021.007 | 30.37 |
| 0059 | 56.324 | 34.77 | 1161.916 | 13.29 | 1061.07 | 27.64 |
| 0060 | 51.937 | 39.85 | 1146.926 | 14.41 | 1016.567 | 30.67 |
| 0061 | 60.897 | 29.47 | 1191.626 | 11.07 | 1028.754 | 29.84 |
| 0062 | 61.895 | 28.31 | 1208.198 | 9.84 | 1039.163 | 29.13 |
| 0063 | 60.636 | 29.77 | 1203.574 | 10.18 | 1039.971 | 29.08 |
| 0064 | 54.625 | 36.74 | 1200.047 | 10.44 | 1017.282 | 30.62 |
| 0065 | 52.298 | 39.43 | 1164.296 | 13.11 | 991.256 | 32.40 |
| 0066 | 56.046 | 35.09 | 1197.383 | 10.64 | 1033.807 | 29.50 |
| 0067 | 57.709 | 33.16 | 1204.716 | 10.10 | 1040.943 | 29.01 |

TABLE 9

| Blend Stocks Blended with Ethanol | | | | | | | | | | | | | |
|---|---|---|---|---|---|---|---|---|---|---|---|---|---|
| Batch ID | Octane Rating | RVP psi | Aromatic cont. (%) | Benzene cont. (%) | Olefins cont. (%) | D86 50% ° F. | D86 90% ° F. | Sulfur ppm | MtBE cont. (%) | EtBE cont. (%) | TAME cont. (%) | Methanol cont. (%) | Ethanol cont. (%) |
| 0068 | 88.8 | 7.22 | 31 | 0.82 | 10.6 | 205 | 332 | 101 | 0 | 0 | 0 | 0 | 3.5 |
| 0069 | 89.6 | 7.19 | 32.6 | 0.82 | 9.8 | 211 | 335 | 85 | 0 | 0 | 0 | 0 | 3.5 |
| 0070 | 88.6 | 7.31 | 36.8 | 0.72 | 8.9 | 212 | 335 | 81 | 0 | 0 | 0 | 0 | 3.5 |
| 0071 | 88.4 | 7.5 | 33.3 | 0.68 | 10.2 | 209 | 334 | 105 | 0 | 0 | 0 | 0 | 3.5 |
| 0072 | 88.1 | 7.34 | 23.81 | 0.44 | 15.65 | 208 | 356 | 271 | 0 | 0 | 0 | 0 | 3.5 |
| 0073 | 87.3 | 7.19 | 31.3 | 0.74 | 10.7 | 219 | 333 | 120 | 0 | 0 | 0 | 0 | 3.5 |
| 0074 | 88 | 7.46 | 28.21 | 0.71 | 19.73 | 203 | 338 | 186 | 0 | 0 | 0 | 0 | 3.5 |

TABLE 10

| Blends Stocks Blended with Ethanol | | | | | | |
|---|---|---|---|---|---|---|
| Batch ID | total toxics mg/mi. | % reduc. toxics | total $NO_x$ mg/mi. | % reduc. $NO_x$ | total VOC mg/mi. | % reduc. VOC |
| 0068 | 61.791 | 25.76 | 1222.92 | 8.74 | 1103.88 | 24.72 |
| 0069 | 62.436 | 25.03 | 1211.86 | 9.56 | 1115.09 | 23.95 |
| 0070 | 63.539 | 24.01 | 1213.11 | 9.47 | 1153.18 | 21.36 |
| 0071 | 62.146 | 25.65 | 1227.91 | 8.37 | 1160.46 | 20.86 |
| 0072 | 60.659 | 28.27 | 1320.81 | 1.43 | 1119.11 | 23.68 |
| 0073 | 62.328 | 25.41 | 1231.00 | 8.13 | 1122.42 | 23.45 |
| 0074 | 62.786 | 24.83 | 1342.47 | 0.00 | 1118.12 | 23.75 |

What is claimed is:

1. An oxygenated transportation fuel complying with the emissions performance requirements of the Clean Air Act Amendments for Conventional Gasoline and for Reformulated Gasoline as predicted by the EPA Complex Model, said transportation fuel comprising a blend of hydrocarbon streams, said blend having the following properties:

a) sulfur content of less than about 300 ppm, b) an octane rating of from about 87 to about 94, c) a 50% D-86 distillation point of less than about 235° F, d) a 90% D-86 distillation point of less than about 360° F, e) an olefins content of greater than about 15%, f) a Reid Vapor Pressure of less than 7.5; and at least one oxygenate.

2. The oxygenated transportation fuel according to claim 1, wherein said at least one oxygenate is selected from the group consisting of ethyl tert-butyl ether, methyl tert-butyl ether, tert-amyl methyl ether, methanol and ethanol.

3. The oxygenated transportation fuel according to claim 1, wherein said a 50% D-86 distillation point is greater than about 215° F.

4. The oxygenated transportation fuel according to claim 1, wherein said a 90% D-86 distillation point is greater than about 315° F.

* * * * *